US006334911B2

(12) United States Patent
Kita et al.

(10) Patent No.: US 6,334,911 B2
(45) Date of Patent: Jan. 1, 2002

(54) HIGH-STRENGTH, HIGH-DUCTILITY ALUMINUM ALLOY

(75) Inventors: Kazuhiko Kita; Koji Saito; Koju Tachi, all of Sendai; Teruaki Onogi, Miyagi; Kenji Higashi, Tondabayashi, all of (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 09/025,778

(22) Filed: Feb. 19, 1998

(30) Foreign Application Priority Data

Feb. 20, 1997 (JP) ..... 9-036408

(51) Int. Cl.[7] ..... C22C 21/00

(52) U.S. Cl. ..... 148/416; 148/438; 148/439; 148/440; 420/529; 420/538

(58) Field of Search ..... 148/438, 439, 148/440, 416; 420/538, 529

(56) References Cited

U.S. PATENT DOCUMENTS 5,053,085 A 10/1991 Masumoto et al. ..... 148/403
5,593,515 A * 1/1997 Matsumoto et al. ..... 148/415

FOREIGN PATENT DOCUMENTS

| | | |
|---|---|---|
| EP | 0 137 180 A1 | 8/1984 |
| EP | 0 675 209 A1 | 3/1995 |
| EP | 0 710 730 A2 | 11/1995 |
| JP | 1-275732 | 11/1989 |
| JP | 6-256875 | 9/1994 |
| JP | 8-199317 | 8/1996 |

OTHER PUBLICATIONS

Journal of Applied Crystallography, 1995, Title: Structural Study of Crystalline Approximants of the Al–Cu–Fe–Cr Decagnol Quasicrystal, pp. 96–104.
Scripta Metallurgica et Materialia, Jan. 1992, USA, vol. 26, No. 2, Title: Multicomponent Al–Cu–Fe–Mn, Al–Cu–Fe–Cr and Al–Cu–Fe–Cr–Mn Quasicrystals, pp. 291–296.

* cited by examiner

*Primary Examiner*—Sikyin Ip
(74) *Attorney, Agent, or Firm*—Finnegan, Henderson, Farabow, Garrett & Dunner, L.L.P.

(57) ABSTRACT

An aluminum alloy having a composition represented by the general formula:

$$Al_{bal}Cu_aM_b \text{ or } Al_{bal}Cu_aM_bTM_c$$

wherein M represents one or two elements selected between Mn and Cr; TM represents at least one element selected from the group consisting of Ti, Zr, V, Fe, Co, and Ni; and a, b and c each represent an atomic percentage of $0<a\leqq3$, $2<b\leqq5$, and $0<c\leqq2$, containing quasi-crystals in the structure thereof, and having an elongation of at least 10% at room temperature and a Young's modulus of at least 85 GPa. The aluminum alloy exhibits excellent mechanical properties such as high-temperature strength, ductility, impact strength and tensile strength and is provided as a rapidly-solidified material, a heat-treated material obtained by heat-treating the rapidly-solidified material, or a consolidated and compacted material obtained by consolidating and compacting the rapidly-solidified material.

14 Claims, 1 Drawing Sheet

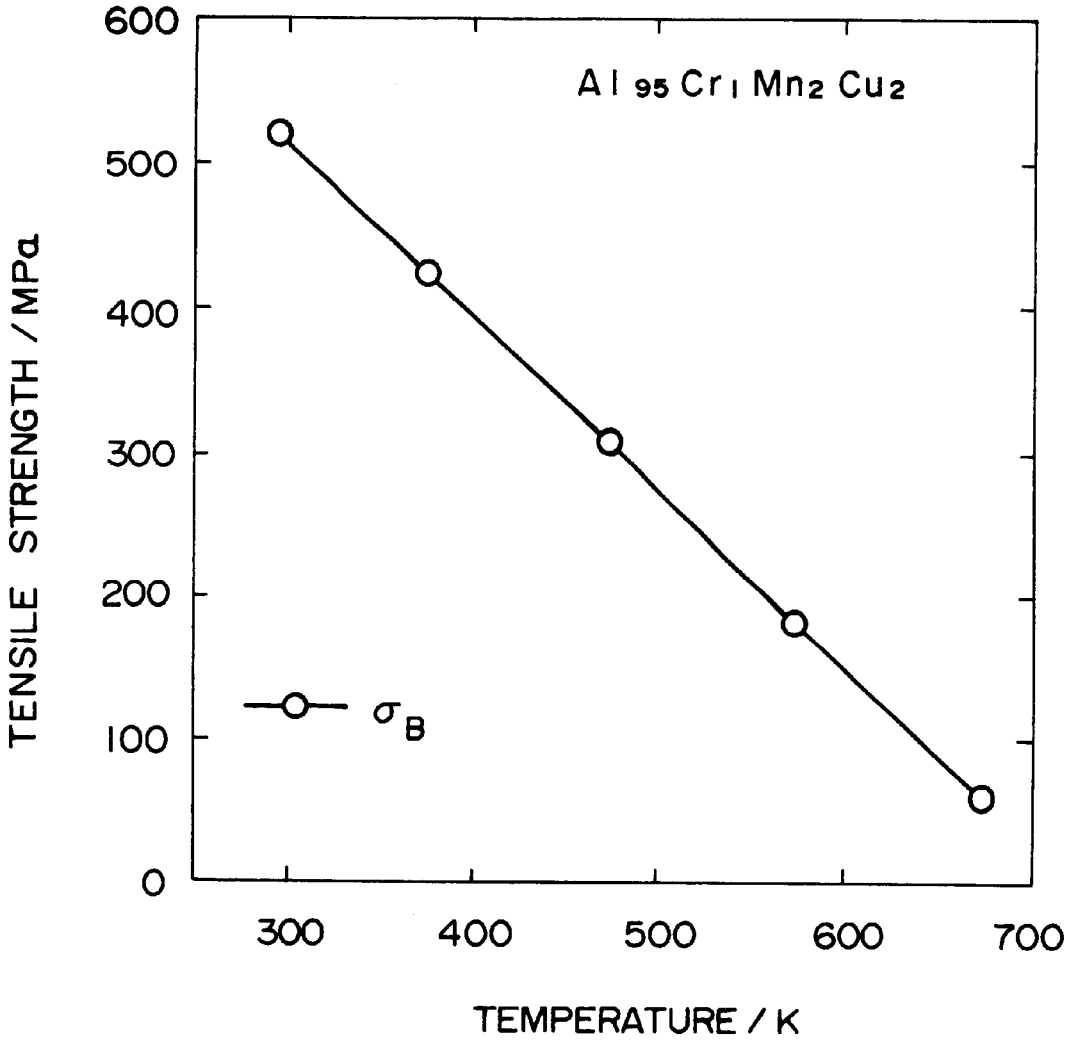
Al 95 Cr 1 Mn2 Cu2
σB
TENSILE STRENGTH / MPa
TEMPERATURE / K
0
100
200
300
400
500
600
300
400
500
600
700

HIGH-STRENGTH, HIGH-DUCTILITY ALUMINUM ALLOY

BACKGROUND OF THE INVENTION

1. Field of the Invention

The present invention relates to an aluminum alloy excellent in mechanical properties such as high-temperature strength, ductility, impact strength and tensile strength.

2. Description of the Prior Art

Aluminum alloys known hitherto include, for example, Al—Cu, Al—Si, Al—Mg, Al—Cu—Si, Al—Cu—Mg and Al—Zn—Mg alloys. They are widely used as members of aircrafts, vehicles, seacrafts, etc., exterior materials, sashes, roof materials, etc. for buildings, members of marine equipment, or members of nuclear reactors depending on the characteristic properties thereof. However, the hardness and thermal resistance of these aluminum alloys are generally insufficient. Under these circumstances, it has been attempted recently to solidify an aluminum alloy material by quenching in order to make the structure thereof fine and also to improve the mechanical properties such as strength thereof and chemical properties such as corrosion resistance (refer to Japanese Patent Laid-Open Nos. 275732/1989, 256875/1994 and 199317/1996). Although these materials are excellent in strength and thermal resistance, they still have room for improvement in ductility and formability so as to improve the practical use thereof.

SUMMARY OF THE INVENTION

The present invention has been completed after intensive investigations made under the above-described circumstances. An object of the present invention is to provide an aluminum alloy excellent in strength, hardness, ductility and formability and having a high specific strength by forming a structure comprising quasi-crystals or crystals close to them which are finely dispersed in an aluminum matrix having a specified composition.

The present invention provides a high-strength, high-ductility aluminum alloy having a composition represented by the general formula:

$$Al_{bal}Cu_aM_b \text{ or } Al_{bal}Cu_aM_bTM_c$$

wherein M represents one or two elements selected between Mn and Cr; TM represents at least one element selected from the group consisting of Ti, V, Fe, Co, Ni and Zr; and a, b and c each represent an atomic percentage of $0<a\leqq 3$, $2<b\leqq 5$ and $0<c\leqq 2$, and containing quasi-crystals in the structure thereof.

BRIEF DESCRIPTION OF THE DRAWING

The single FIGURE is a graph showing the test results of the high-temperature strength of the alloy of the present invention.

DETAILED DESCRIPTION OF THE PREFERRED EMBODIMENT

In the present invention, the quasi-crystal particles are composed of three indispensable elements of Al, Cu and M. The combination of elements Al and M is indispensable for the formation of quasi-crystals. When the amount of M is 2 atomic % or less, no quasi-crystals can be formed and the extent of strengthening is insufficient. When a combination of Mn and Cr is used as M even in a small amount, the formation of the quasi-crystal phase becomes possible by the synergistic effect of them and the quasi-crystal phase thus obtained is stable. When the amount of M exceeds 5 atomic %, the quasi-crystal particles become coarse and the volume ratio thereof becomes excess and lowers the ductility. TM as the constituent element of the quasi-crystals contributes to the strengthening and, when it is dissolved in a matrix to form a solid solution, it strengthens the matrix. Further, TM can be in the form of an intermetallic compound effective in strengthening the alloy. When the amount of TM exceeds 2 atomic %, no quasi-crystals can be formed and a coarse intermetallic compound is formed to seriously reduce the ductility. Under the conditions of $b\geqq a$ and $b\geqq a+c$, the quasi-crystals can be further stabilized and the matrix and the intermetallic compound can be made in more useful forms.

The particles of the quasi-crystals are desirably not larger than 1 $\mu$m, more desirably not larger than 500 nm. Copper is an element which forms a solid solution in the matrix and which is precipitated to strengthen the matrix. When no copper is contained in the matrix, the strength of the matrix is insufficient. When the amount of the copper exceeds 3 atomic %, it is precipitated in the form of coarse $Al_2Cu$ in the matrix to reduce the ductility.

The quasi-crystals are in an icosahedral phase (I phase) or decagonal phase (D phase) or a crystal phase close to these crystal phases (hereinafter referred to as an "approximate crystal phase"). The structure thereof comprises the quasi-crystal phase and an aluminum phase or the quasi-crystal phase and a supersaturated solid solution phase of aluminum. If necessary, the structure may contain various intermetallic compounds formed from aluminum and other elements and/or other intermetallic compounds formed from other elements. The intermetallic compounds are particularly effective in strengthening the matrix and also in controlling the crystal particles.

The amount of the quasi-crystals contained in the alloy structure is preferably 20 to 80% by volume. When it is below 20% by volume, the object of the present invention cannot be perfectly attained and, on the contrary, when it exceeds 80% by volume, the embrittlement of the alloy might be caused to make the sufficient processing of the obtained material impossible. The amount of the quasi-crystals contained in the alloy structure is still preferably 50 to 80% by volume. The average particle size in the aluminum phase or the phase of the supersaturated solid solution of aluminum is preferably 40 to 2,000 nm in the present invention. When the average particle size is below 40 nm, the obtained alloy will have an insufficient ductility though it has a high strength and a high hardness. When it exceeds 2,000 nm, the strength is sharply lowered to make the production of the high-strength alloy impossible.

The aluminum alloy of the present invention can be directly obtained from the molten alloy having the above-described composition by the single-roller melt-spinning method, twin-roller melt-spinning method, in-rotating-water melt-spinning method, various atomizing methods, liquid-quenching method such as spray method, sputtering method, mechanical alloying method or mechanical gliding method. In these methods, the cooling rate which varies to some extent depending on the composition of the alloy is about $10^2$ to $10^4$ K/sec. The aluminum alloy of the present invention precipitate the quasi-crystals from the solid solution by heat-treating the material rapidly solidified by the above-described method or by consolidating the rapidly-solidified material and subjecting it to thermal processing such as compaction or extrusion. The temperature in this step is preferably 320 to 500° C.

The elongation of the alloy obtained by the present invention is at least 10% and the Young's modulus thereof is at least 85 GPa.

The following Examples will further illustrate the present invention.

An aluminum alloy powder having a composition shown in the left column in Table 1 was prepared with a gas atomizer. The aluminum alloy powder thus obtained was fed into a metal capsule and then -degassed to obtain a billet to be extruded. The billet was extruded with an extruder at a temperature of 320 to 500° C.

The strength, elongation, modulus of elasticity (Young's modulus) and hardness of the extruded material (consolidated material) obtained under the above-described production conditions were determined at room temperature. Further, as for Samples Nos. 15 and 17, the Charpy impact values thereof were also determined. The results are given in the right columns in Table 1.

TABLE 1

| | Alloy (at %) | Strength (MPa) | Elongation (%) | Charpy ($J/cm^2$) | Young's modulus (GPa) | Hardness (Hv) |
|---|---|---|---|---|---|---|
| 1 | $Al_{bal}Mn_5Cu_2$ | 658 | 10 | | 87 | 188 |
| 2 | $Al_{bal}Mn_4Cu_3$ | 675 | 11 | | 86 | 191 |
| 3 | $Al_{bal}Mn_4Cu_2Co_1$ | 690 | 12 | | 92 | 195 |
| 4 | $Al_{bal}Mn_5Cu_1$ | 574 | 11 | | 88 | 168 |
| 5 | $Al_{bal}Mn_4Cu_1$ | 551 | 20 | | 88 | 161 |
| 6 | $Al_{bal}Mn_3Cu_2$ | 566 | 20 | | 87 | 166 |
| 7 | $Al_{bal}Cr_4Cu_1$ | 567 | 18 | | 88 | 160 |
| 8 | $Al_{bal}Cr_1Mn_3Cu_1$ | 505 | 16 | | 85 | 140 |
| 9 | $Al_{bal}Cr_1Mn_3Cu_3$ | 571 | 14 | | 92 | 164 |
| 10 | $Al_{bal}Cr_1Mn_3Cu_2Ti_1$ | 600 | 12 | | 92 | 175 |
| 12 | $Al_{bal}Cr_1Mn_2Cu_2V_1$ | 560 | 15 | | 90 | 161 |
| 13 | $Al_{bal}Cr_1Mn_2Cu_3$ | 500 | 21 | | 90 | 147 |
| 14 | $Al_{bal}Cr_1Mn_2Cu_1Co_2$ | 570 | 15 | | 93 | 175 |
| 15 | $Al_{bal}Cr_1Mn_2Cu_2$ | 520 | 20 | 16 | 88 | 145 |
| 16 | $Al_{bal}Cr_1Mn_2Cu_{1.5}Zr_{0.5}$ | 572 | 16 | | 91 | 165 |
| 17 | $Al_{bal}Cr_1Mn_3Cu_1$ | 515 | 18 | 8.8 | 88 | 147 |
| 18 | $Al_{bal}Cr_1Mn_2Cu_1Fe_1$ | 560 | 14 | | 90 | 163 |
| 19 | $Al_{bal}Mn_3Cu_1Ni_1$ | 545 | 15 | | 87 | 159 |
| 20 | $Al_{bal}Cr_1Mn_3Cu_1Ni_1$ | 558 | 12 | | 86 | 163 |
| 21 | $Al_{bal}Cr_1Mn_2Cu_1Ni_2$ | 553 | 14 | | 89 | 162 |
| 22 | $Al_{bal}Cr_2Mn_1Cu_1Co_1$ | 543 | 16 | | 89 | 154 |

The results given in Table 1 indicate that the alloys (consolidated materials) of the present invention are excellent in strength, elongation, modulus of elasticity (Young's modulus), hardness, etc. at room temperature, and in particular, they have an elongation of as high as at least 10% and a modulus of elasticity (Young's modulus) of as high as 85 GPa. It was apparent that although the properties of each alloy were changed by heating in the step of preparing the consolidated material, the properties were still excellent.

The extruded material obtained under the above-described production conditions was cut to obtain test pieces for the TEM observation, and the structure of the alloy and the particle sizes in the respective phases were examined. The results of the TEM observation indicated that the quasi-crystals comprised the icosahedral phase alone or a mixture of the icosahedral phase and the decagonal phase. An approximant crystal phase thereof was recognized depending on the kind of the alloy. The amount of the quasi-crystals in the structure was 20 to 80% by volume.

The alloy structure comprised a mixture of an aluminum phase and the quasi-crystal phase or a supersaturated solid solution phase of aluminum and the quasi-crystal phase. Particularly in an alloy containing the TM elements, such a structure further comprised a phase of various intermetallic compounds (intermetallic compound phase of aluminum and TM elements). The average particle size in the aluminum phase or supersaturated solid solution phase of aluminum was 40 to 2,000 nm, and that in the quasi-crystal phase was 10 to 1,000 nm and mostly not larger than 500 nm. When the alloy contained the intermetallic compound phase, the average particle size thereof was 10 to 1,000 nm. In a composition wherein the intermetallic compound phase was precipitated, the intermetallic compound phase was homogeneously and finely dispersed in the alloy structure. Supposedly, the control of the alloy structure, particle sizes in each phase, etc. was effected by the degassing (including compaction in the degassing step) and the heat processing in the extrusion step.

The high-temperature strength of $Al_{95}C_1Mn_2Cu_2$ alloy (No. 15 in Table 1) was determined. The high-temperature strength was determined at a predetermined temperature (373 K, 473 K, 573 K or 673K) after keeping the sample at that temperature for one hour. The results are shown in the figure. It is apparent from the figure that the high-temperature strength of the alloy of the present invention was as high as 423 MPa at 373 K, 307 MPa at 473 K and 183 MPa at 573 K, while that of Extra Super Duralumin (7075) which is a commercially available high-strength aluminum alloy was 397 MPa at 373 K, 245 MPa at 473 K and 83 MPa at 573 K. The strength is particularly high at 473 K (200° C.) and 573 K (300° C.).

As described above, the alloy of the present invention is excellent in strength, elongation, modulus of elasticity (Young's modulus), hardness, etc. at room temperature, and in particular, it has an elongation of as high as at least 10% and a modulus of elasticity (Young's modulus) of as high as at least 85 GPa. Although the properties of the alloy are changed by heating in the step of preparing the consolidated material, the properties are still excellent.

What is claimed is:

1. A high-strength, high-ductility aluminum alloy consisting essentially of a composition represented by the general formula:

$$Al_{bal}Cu_aM_b$$

wherein M represents one or two elements selected between Mn and Cr; and a and b each represent an atomic percentage of $1 \leqq a \leqq 3$, $3 \leqq b \leqq 5$, and containing quasi-crystals in the structure thereof, wherein said high-strength, high-ductility aluminum alloy has an elongation of at least 10% at room temperature and a Young's modulus of at least 85 GPa.

2. A high-strength, high-ductility aluminum alloy consisting essentially of a composition represented by the general formula:

$$Al_{ba}Cu_aM_bTM_c$$

wherein M represents one or two elements selected between Mn and Cr; TM represents at least one element selected from the group consisting of V, Fe, Co and Ni; and a, b and c each represent an atomic percentage of $1 \leqq a \leqq 3$, $3 \leqq b \leqq 5$, $1 \leqq c \leqq 2$, and containing quasi-crystals in the structure thereof, wherein said high-strength, high-ductility aluminum alloy has an elongation of at least 10% at room temperature and a Young's modulus of at least 85 GPa.

3. The high-strength, high-ductility aluminum alloy set forth in claim 1, wherein the quasi-crystals are in an icosahedral phase (I phase) or decagonal phase (D phase) or in an approximant crystal phase thereof.

4. A. The high-strength, high-ductility aluminum alloy set forth in claim 1, wherein the amount of the quasi-crystal phase in the structure is 20 to 80% by volume.

5. The high-strength, high-ductility aluminum alloy set forth in claim 1, wherein the structure of the alloy comprises the quasi-crystal phase and an aluminum phase or the quasi-crystal phase and a supersaturated solid solution phase of aluminum.

6. The high-strength, high-ductility aluminum alloy set forth in claim 5 which further contains various intermetallic compounds formed from aluminum and other elements and/or intermetallic compounds formed from other elements.

7. The high-strength, high-ductility aluminum alloy set forth in claim 1, which is a rapidly-solidified material, a heat-treated-material obtained by heat-treating the rapidly-solidified material, or a consolidated and compacted material obtained by consolidating and compacting the rapidly-solidified material.

8. The high-strength, high-ductility aluminum alloy set forth in claim 1, wherein $b \geqq a$.

9. The high-strength, high-ductility aluminum alloy set forth in claim 2, wherein the quasi-crystals are in an icosahedral phase (I phase) or decagonal phase (D phase) or in an approximant crystal phase thereof.

10. The high-strength, high-ductility aluminum alloy set forth in claim 2, wherein the amount of the quasi-crystal phase in the structure is 20 to 80% by volume.

11. The high-strength, high-ductility aluminum alloy set forth in claim 2, wherein the structure of the alloy comprises the quasi-crystal phase and an aluminum phase or the quasi-crystal phase and a supersaturated solid solution phase of aluminum.

12. The high-strength, high-ductility aluminum alloy set forth in claim 11 which further contains various intermetallic compounds formed from aluminum and other elements and/or intermetallic compounds formed from other elements.

13. The high-strength, high-ductility aluminum alloy set forth in claim 2, which is a rapidly-solidified material, a heat-treated material obtained by heat-treating the rapidly-solidified material, or a consolidated and compacted material obtained by consolidating and compacting the rapidly-solidified material.

14. The high-strength, high-ductility aluminum alloy set forth in claim 2, wherein $b \geqq a+c$.

* * * * *